United States Patent [19]

Rastetter

[11] 3,995,534

[45] Dec. 7, 1976

[54] SAFETY ARRESTER FOR ARRESTING A HYDRAULICALLY OPERATED LIFTING RAM OF A HYDRAULIC ELEVATOR

[76] Inventor: Adolf Rastetter, Hermann-Hesse-Strasse 56, 75 Karlsruhe, Germany

[22] Filed: June 27, 1974

[21] Appl. No.: 483,799

[30] Foreign Application Priority Data

June 30, 1973 Germany ..... 2333491

[52] U.S. Cl. ..... 92/27; 91/44; 92/24; 92/60; 188/67; 188/170

[51] Int. Cl.[2] ..... F15B 15/26

[58] Field of Search ..... 92/23, 24, 27, 28, 29, 92/82, 60; 91/41, 44; 188/67, 170

[56] References Cited

UNITED STATES PATENTS

| | | | |
|---|---|---|---|
| 294,086 | 2/1884 | Sickels | 92/28 X |
| 2,377,032 | 5/1945 | Osborne | 92/28 X |
| 2,730,994 | 1/1956 | Light | 91/44 X |
| 2,815,736 | 12/1957 | Wright | 92/24 X |
| 2,889,895 | 6/1959 | Snow | 92/28 X |
| 3,173,257 | 3/1965 | Lucien | 91/41 X |
| 3,203,513 | 8/1965 | Allen | 92/28 X |
| 3,230,784 | 1/1966 | Von Heidenstam et al. | 92/29 X |
| 3,420,144 | 1/1969 | Berry | 92/24 X |
| 3,470,793 | 10/1969 | Hanchen | 92/24 X |
| 3,556,259 | 1/1971 | Allen | 188/67 |
| 3,575,087 | 4/1971 | Sherwood | 92/23 |

FOREIGN PATENTS OR APPLICATIONS

| | | | |
|---|---|---|---|
| 969,551 | 9/1964 | United Kingdom | 188/170 |
| 262,355 | 1/1970 | U.S.S.R. | 92/28 |

*Primary Examiner*—Martin P. Schwadron
*Assistant Examiner*—Abraham Hershkovitz
*Attorney, Agent, or Firm*—Wenderoth, Lind & Ponack

[57] ABSTRACT

A safety arrester for arresting a hydraulically operated lifting ram of a hydraulic elevator comprises an arrester body within which a plurality of brake shoes are located. The brake shoes are segments of a ring around a passage through the arrester body for receiving the ram, are spring biassed into frictional engagement with the ram, and are displaceable out of engagement with the ram by hydraulic actuator means.

8 Claims, 2 Drawing Figures

SAFETY ARRESTER FOR ARRESTING A HYDRAULICALLY OPERATED LIFTING RAM OF A HYDRAULIC ELEVATOR

BACKGROUND OF THE INVENTION

The invention relates to a safety arrester for arresting a hydraulically operated lifting ram of a hydraulic elevator.

In many instances hydraulic lifting rams require safety devices to prevent the ram, when extended, from collapsing when there is a sudden fall in hydraulic pressure due to a fault. In the absence of any safety measures such a fault could be extremely hazardous, since it could cause a passanger cage or a lifting platform to fall.

Arrester devices have already been proposed which respond to excessive ram speed. However, the connection between a release lever of the known arrester device and a control line attached to the lever are a particular source of weakness. Particularly when maintenance and assembly have been careless, the failure of this arrangement may cause the entire arrester device to fail. Moreover, in hydraulic lifting installations the provision of an automatically closing safety valve has also been proposed for isolating the lifting cylinder and thereby preventing the ram from continuing to descend when a pipe fracture has occured and the pressure suddenly and undesirably falls for this or some other reason. Such a safety arrangement does not have a satisfactory all-round protective effect because the results of a leakage in the lifting cylinder itself cannot be controlled by the closure of such a valve.

Brake means which comprise band-like elements embracing the ram are also known, as are brake means comprising a wedge member controlled by hydraulic pressure and cooperating with one side of the ram. None of the known forms of construction provides full protection and safety in every circumstance that may arise.

SUMMARY OF THE INVENTION

The object of the invention is therefore the provision of a safety arrester for hydraulically operable lifting rams, which can ensure a fail-safe immobilisation of the ram when there is an undesirable pressure drop in the hydraulic system and which by reason of its simplicity still remains functionable for long periods even when exposed to fouling under conditions of unsatisfactory maintenance.

This object is fulfilled by the present invention which provides a safety arrester for arresting a hydraulically operated lifting ram of a hydraulic elevator, the arrester comprising an arrester body having a passage therethrough adapted to receive the ram, a cavity within the arrester body surrounding the passage, a plurality of brake shoes located within the cavity, and hydraulic actuator means for the brake shoes, the brake shoes comprising segments of a ring surrounding the passage, the brake shoes being spring-biassed firmly to embrace and frictionally engage the ram when the ram is received in the passage, and the brake shoes being displaceable out of frictional engagement with the ram by the hydraulic actuator means when the pressure of working fluid within the hydraulic actuator means exceeds a predetermined level.

As hydraulic actuator means, the arrester body may be provided with cylindrical bores containing slidable plungers for displacing the brake shoes.

The spring bias which directly loads the brake shoes may be overcome by the normal service pressure of the working fluid which operates the ram. Nevertheless the spring bias is sufficiently high to reliably ensure that the brake shoes will grip and hold the ram when the hydraulic pressure falls inadmissibly.

The transmission of thrust from the plungers to the brake shoes may be direct or through an interposed annular plate or the like. The brake shoes may be subdivided in various ways, provided they can exercise a substantially uniform grip all round the ram when they operate. Conveniently the brake shoes may be three 120° segments of a ring.

The arrester body may suitably have a top arranged to face upwardly of the elevator ram, and a bottom arranged to face downwardly of the ram. The cavity in the body may then suitably be defined in part by inclined outer walls around the passage, the walls being inclined, in a direction downwardly of the arrester body, to approach the passage, with the brake shoes slidable downwardly along the walls thereby to become wedged between the walls and the ram when the ram is received in the passage. Anti-friction bearings may suitably be interposed between the brake shoes and the inclined walls. Response of the arrester is thus improved.

It may also be useful to provide the brake shoes with linings of a friction material for engagement with the ram, or the shoes may entirely consist of such a material which, when engaging the ram will not damage the surface of the ram. Such a lining may be similar to conventional brake linings used on disc and other brakes.

In a further development of the invention the cavity in the arrester body may be closed by a cover plate containing a gland for the sealing passage therethrough of the ram. The cover plate may retain the ends of compression springs contained in blind holes in the brake shoes to provide the spring bias urging the brake shoes into a "ram engaging" position. Such an arrangement will afford protection against the ingress of dirt into the interior of the arrester body.

It is also desirable that the arrester should be freely movable on the ram and that stop means should be provided for limiting the entrainment of the arrester by the ram during lifting, the arrester resting on a head end of the ram cylinder when the arrester engages the ram. This arrangement facilitates re-starting after the interceptor has been caused to engage the ram because an initial length of ram movement is available before the brake shoes must be made to release their grip on the ram. At the end of this movement the further entrainment of the arrester is stopped by impact with abutment means which will reliably cause the brake shoes to release.

In the above described general form of construction it may also be advantageous for the supply pipe for supplying working fluid to the arrester to incorporate a valve which is adapted rapidly to connect the pressure fluid entry to the arrester to exhaust whenever the fluid pressure in the hydraulic system tends to fall. This will operate to prevent a minor leak which causes a slow pressure collapse from resulting in a gradual descent of the ram. For the design of the valve, several conventional possibilities are available, any one of which could be employed.

BRIEF DESCRIPTION OF THE DRAWINGS

By way of example the accompanying drawings illustrate a preferred embodiment of the invention. In the drawings.

DETAILED DESCRIPTION OF THE INVENTION

Figure 1:
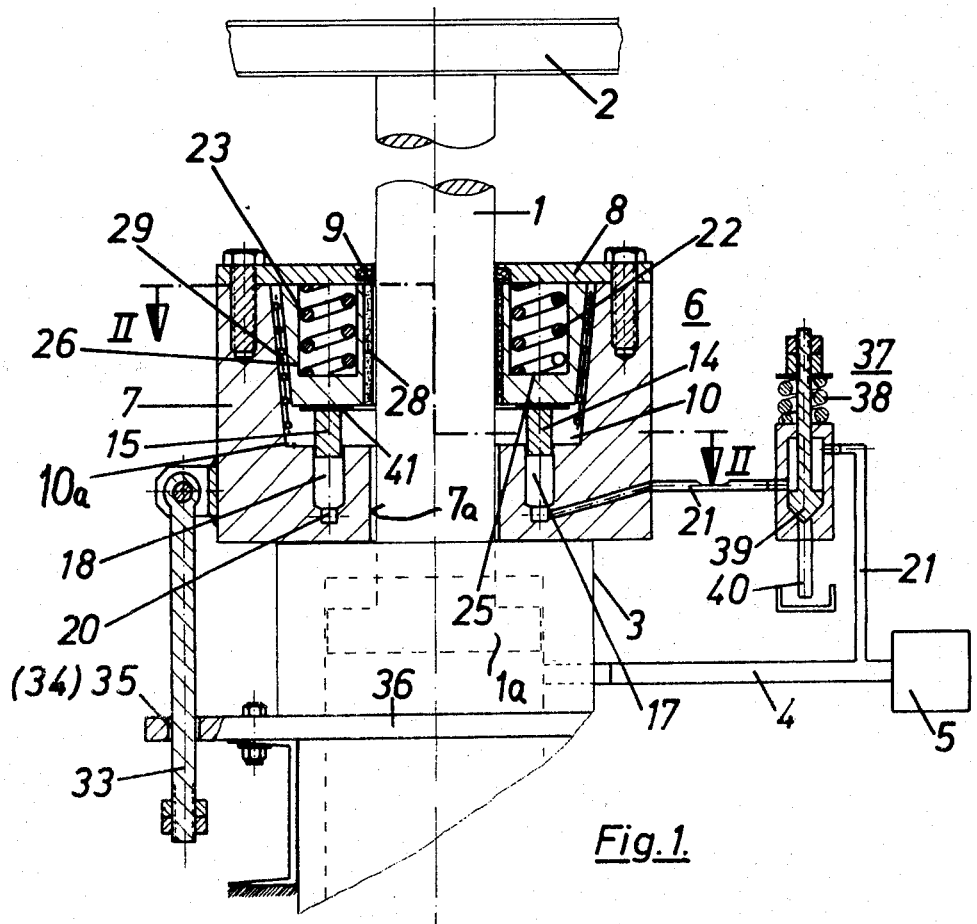
FIG. 1 is a longitudinal cross-section through a safety arrester according to the invention, taken on the line I—I in FIG. 2.
Figure 2:
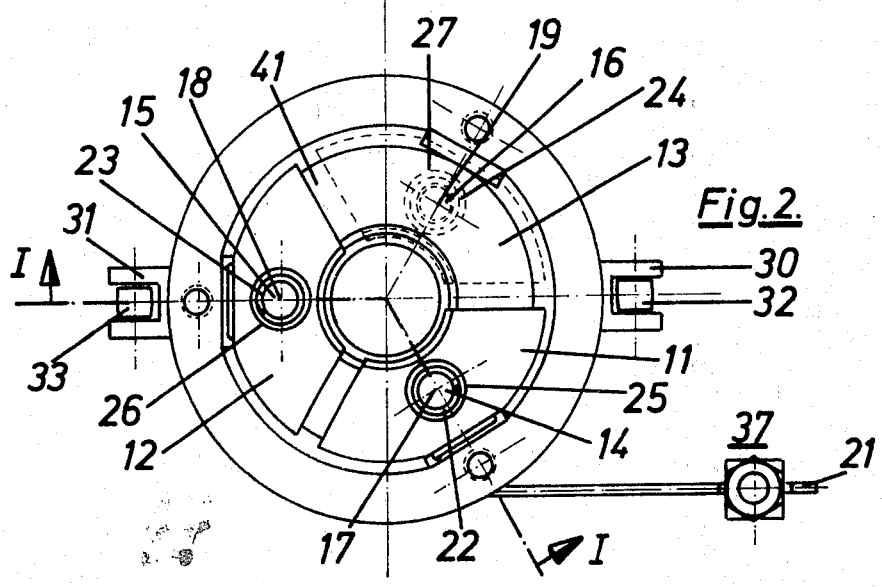
FIG. 2 is a cross-section taken on line II—II in FIG. 1.

Referring now to FIG. 1, a hydraulically operated lifting ram 1 of a hydraulic elevator carries an elevator cage at its upper free end, and the bottom end of the ram 1 is provided with a piston 1*a* which is slidable within a working cylinder 3. A pumping unit 5 supplies hydraulic fluid to the cylinder 3 through a pipe 4. Although, in the interests of simplicity, the pipe 4 shown in the drawing is connected to the cylinder 3 near to the top of the cylinder, it will, in practice, be connected to the cylinder below the lowermost point which can be reached by the piston 1a when the ram 1 is fully retracted.

A safety arrester 6 is carried on the top or head of the cylinder 3. The safety arrester 6 includes an annular arrester body 7 having a central passage 7*a* therethrough occupied by the ram 1. A cavity 10 formed in the arrester body 7 surrounds the central passage 7*a*, and thus also the ram 1, and is closed at the top of the arrester body by a cover plate 8 which has a central aperture for passage of the ram. The cover plate 8 includes a gland 9 which surrounds the central aperture and sealingly and slidably engages the ram 1. The gland 9 also serves to keep the ram clean. The cavity 10 is defined in part by inclined outer walls 10*a* around the passage 7*a* which, in a direction downwardly of the arrester body, approach the passage.

The inclined walls 10*a* serve as inclined guideways for three slidably moveable brake shoes 11, 12 and 13 which are segments of a ring surrounding the passage 7*a*. The brake shoes are displaceable respectively by actuating plungers 14, 15 and 16 which are slidable in corresponding cylindrical bores 17, 18 and 19; the actuating plungers and corresponding bores each forming part of a hydraulic actuator for displacing the brake shoes. Thrust from the plungers 14, 15 and 16 is transmitted to the brake shoes 11, 12 and 13 via an annular plate 41. The cylindrical bores 17, 18 and 19 are interconnected by a ring shaped duct 20 for the working fluid.

The brake shoes 11, 12 and 13 are each spring biassed downwardly (FIG. 1) by respective coiled compression springs 22, 23 and 24 which are contained in respective blind bores 25, 26 and 27 in the brake shoes 11, 12 and 13. The springs 22, 23 and 24 bear upwardly upon, but are held down by, the cover plate 8. The downward bias applied to the brake shoes 11, 12 and 13 by the springs 22, 23 and 24 will urge the brake shoes to slide downwardly along the inclined outer walls 10*a* to become wedged between the walls 10*a* and the ram 1 in the passage 7*a*. The wedged shoes will firmly embrace and frictionally engage the ram 1.

The radially inner faces of the brake shoes 11, 12 and 13 which are opposed to the ram 1 are lined with a friction lining material 28 and the radially outer surfaces of the brake shoes bear upon the inclined outer walls 10*a* of the cavity 10 through the intermediary of anti-friction caged roller bearings 29.

The ram 1 is entirely free in relation to the arrester 6 when the brake shoes 11, 12 and 13 have been displaced, i.e. released, by the hydraulic actuator. The arrester body 7 is provided with lugs 30, 31 which carry screw-threaded tie rods 32, 33 — possibly of adjustable length. The tie rods 32, 33 are hinged to the lugs 30, 31 and releasably engage slots 34, 35 in an abutment collar 36 secured to the head of the cylinder 3.

A hydraulic fluid supply pipe 21 incorporates a valve 37 containing a valve piston 39 biassed by a restoring spring 38 to a position in which it uncovers an exhaust 40.

When the pumping unit 5 generates a predetermined hydraulic service pressure within the cylinder 3, this pressure also suffices to displace the valve piston 39 in the supply pipe 21 into the position shown in FIG. 1 and the hydraulic working fluid under pressure can then enter the ring duct 20 through the pipe 21. The pressure of the hydraulic fluid will lift the plungers 14, 15, 16 and hence will lift the brake shoes 11, 12 and 13 against the resistance of the coil springs 22, 23, 24 so that the brake shoes will no longer be wedged against the ram 1. However, should there be a sudden accidental pressure drop, the thrust of the coil springs 22, 23, 24 will exceed the force exerted by the plungers 14, 15, 16 and the brake shoes will move downwardly and become wedged between the sides of the cavity and the ram 1, with the friction lining material 28 engaging the ram 1. The safety arrester will thus grip the ram 1 tightly and, since the arrester body is supported by the head of the cylinder 3 beneath it, any further descent of the ram will be prevented.

When pressure begins to build up again within the cylinder 3 and the pipe 21, the safety arrester will initially remain in engagement with the ram and will move upwardly together with the ram 1 until the tie rods 33 limit further upward movement of the arrester 6 and thereby simultaneously release the brake shoes 11, 12, 13. Pipe 21 will of course have a degree of flexibility sufficient to allow such movement.

The bias of the restoring spring 38 is adjustable and should the hydraulic pressure at any time continue to fall below a level to which the bias of the restoring spring 38 of the valve 37 can be adjusted, i.e. a predetermined minimum level, then the valve piston 39 will be retracted to establish fluid communication between the pipe 21 and the exhaust 40. The fluid from within the safety arrester will thus be vented through the exhaust 40, and the abrupt collapse of fluid pressure will cause the brake shoes 11, 12, 13 instantantly to grip the ram 1.

The features which characterise the present invention provide a safety arrester which will reliably prevent hydraulically operable rams from falling, and which can also be applied to existing installations at a reasonable cost.

It will be understood that the description of the present embodiment is given for purposes of illustration only and that the invention can be embodied in other forms within the spirit and scope of the appended claims.

An important application of the invention lies in the field of hydraulically operated lifting platforms for cars etc.

I claim:

1. In a hydraulic elevator drive of the type including a hydraulic cylinder, a piston movable in said cylinder by hydraulic fluid from a fluid pressure source, a lifting ram connected to said piston, and a safety arrester for arresting movement of said ram; the improvement wherein said safety arrester comprises:

an arrester body having an upper end and a lower end, said body having extending upwardly therethrough a passage, said ram being received in said passage, said body having therein a cavity surrounding a portion of said passage, said cavity being partially defined by planar walls of said body, said planar walls being inclined inwardly from said upper end to said lower end;

a plurality of brake shoes positioned in said cavity, said brake shoes comprising segments of a ring surrounding said ram, each said brake shoe having an outer surface including an inclined planar portion corresponding to and cooperating with a respective said planar wall of said body;

a plurality of spring means, one each directly connected to a respective of said brake shoes, for biasing said brake shoes toward said lower end of said body into sliding relationship with said inclined planar walls, and for thereby forcing said brake shoes inwardly into locking frictional engagement with said ram; and a plurality of hydraulic actuator means, one each directly connected to respective of said brake shoes, actuatable by the pressure of said hydraulic fluid in said hydraulic cylinder for urging said brake shoes toward said upper end of said body against the force of said spring means only when said pressure is above the level sufficient to move said piston and ram.

2. The improvement claimed in claim 1, wherein said hydraulic actuator means comprise a plurality of plungers slidable in corresponding cylindrical bores in said arrester body, said plungers being moveable by said hydraulic fluid for displacing the respective said brake shoes and each bearing against the lower face of the respective said brake shoe.

3. The improvement claimed in claim 1, further comprising anti-friction bearing means interposed between outer surfaces of said brake shoes and said inclined planar walls of said cavity.

4. The improvement claimed in claim 1, further comprising friction linings on said brake shoes for frictionally engaging said ram.

5. The improvement claimed in claim 1, wherein said cavity is closed at said upper end of said arrester body by a cover plate, said cover plate having an aperture therein through which said ram extends, and further comprising a gland around said aperture providing a sliding seal between said cover plate and said ram, wherein said spring means comprises compression springs received in blind holes in the respective said brake shoes and bearing upwardly upon said cover plate.

6. The improvement claimed in claim 1, wherein said arrester is freely movable upwardly and downwardly on said ram in such way that when said pressure of said hydraulic fluid within said hydraulic actuator means falls below said level said arrester will remain fixed to said ram, and thereafter when said pressure of said hydraulic fluid within said hydraulic actuator means rises to exceed said level said arrester will initially move upwardly with said ram, and further comprising means connected to said arrester and said cylinder for limiting the amount of such upward movement of said arrester.

7. The improvent claimed in claim 1, further comprising a supply pipe means for feeding said hydraulic fluid to said hydraulic actuator means, and valve means in said supply pipe means for rapidly venting hydraulic fluid from said hydraulic actuator means whenever said pressure of said hydraulic fluid for lifting said ram falls below said level.

8. The improvement claimed in claim 1, wherein said arrester body comprises, in the circumferential direction thereof, a single and unitary member.

* * * * *